US007661990B1

(12) United States Patent
Chiang

(10) Patent No.: US 7,661,990 B1
(45) Date of Patent: Feb. 16, 2010

(54) ELECTRICAL CONNECTOR

(75) Inventor: Shu-Man Chiang, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/232,770

(22) Filed: Sep. 24, 2008

(51) Int. Cl.
*H01R 13/648* (2006.01)

(52) U.S. Cl. ..... 439/607.35; 439/607.54

(58) Field of Classification Search ..... 439/607.35, 439/607.54, 660, 607.01
See application file for complete search history.

(56) References Cited

U.S. PATENT DOCUMENTS 6,106,338 A * 8/2000 Wu et al. ..... 439/660
6,270,379 B1 * 8/2001 Huang et al. ..... 439/660
6,592,405 B1 * 7/2003 Hasircoglu ..... 439/607.54
7,160,120 B2 * 1/2007 Zhang et al. ..... 439/79
7,467,977 B1 * 12/2008 Yi et al. ..... 439/607.01
7,479,042 B2 * 1/2009 Chen ..... 439/660
2003/0129876 A1 * 7/2003 Hasircoglu ..... 439/607
2005/0227543 A1 * 10/2005 Masumoto et al. ..... 439/660
2009/0042450 A1 * 2/2009 Zheng et al. ..... 439/660

* cited by examiner

*Primary Examiner*—Gary F. Paumen
(74) *Attorney, Agent, or Firm*—Rosenberg, Klein & Lee

(57) ABSTRACT

An electrical connector includes a dielectric housing, a plurality of terminals and a shield. The dielectric housing defines a plurality of terminal grooves therein for receiving the terminals. At least one recess is formed in an outer surface of the dielectric housing. The shield has a plurality of sidewalls to define a receiving space therebetween for receiving the dielectric housing therein. At least one of the sidewalls is punched inward at a portion corresponding to the recess of the dielectric housing to form a retaining portion restricted in the recess after the dielectric housing is mounted in the receiving space. The retaining portion is restricted in the recess for fixing the dielectric housing inside the shield. The depth of the recess and the retaining portion restricted in the recess is not limited by the depth of the material of the shield. The dielectric housing is fixed in the shield firmly.

9 Claims, 5 Drawing Sheets

ELECTRICAL CONNECTOR

BACKGROUND OF THE INVENTION

1. Field of the Invention

The present invention generally relates to a connector, and more particularly to an electrical connector.

2. The Related Art

Please refer to FIGS. 6 and 7, a conventional electrical connector 100' is shown. The electrical connector 100' includes a dielectric housing 1', a shield 2' surrounding the dielectric housing 1' and a plurality of terminals 3' received in the dielectric housing 1'. The dielectric housing 1' defines a groove 11' therein the depth of which is substantially equal to the depth of the material of the shield 2'. Two projections 12' are protruded from a bottom surface of the groove 11'. The height of the projection 12' is substantially equal to the depth of the groove 11'. The shield 2' has a board 21' received in the groove 11' of the dielectric housing 1'. Two apertures 22' are formed in the board 21' of the shield 2'. The two projections 12' of the dielectric housing 1' are respectively received in the apertures 22' of the shield 2' for fixing the dielectric housing 1' in the shield 2'.

However, the specification of the electrical connector 100' is demanded to be made more and more small, the depth of the shield 2' and the groove 11', and the height of the projections 12' need to be as thin as possible. When a complementary connector is inserted into the electrical connector 100', a push force will be transferred to the dielectric housing 1', which makes the projections 12' easy to be out of the apertures 22'. The electrical connection between the electrical connector 100' and the complement connector will be unsteady.

SUMMARY OF THE INVENTION

An object of the present invention is to provide an electrical connector. The electrical connector includes a dielectric housing, a plurality of terminals and a shield. The dielectric housing defines a plurality of terminal grooves therein for receiving the terminals. At least one recess is formed in an outer surface of the dielectric housing. The shield has a plurality of sidewalls to define a receiving space therebetween for receiving the dielectric housing therein. At least one of the sidewalls is punched inward at a portion corresponding to the recess of the dielectric housing to form a retaining portion restricted in the recess after the dielectric housing is mounted in the receiving space of the shield.

As described above, after the dielectric housing is mounted in the shield, the retaining portion of the shield is punched to be restricted in the recess formed in the dielectric housing, the depth of the recess and the retaining portion restricted in the recess is not limited by the depth of the material of the shield. The dielectric housing is fixed in the shield firmly.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
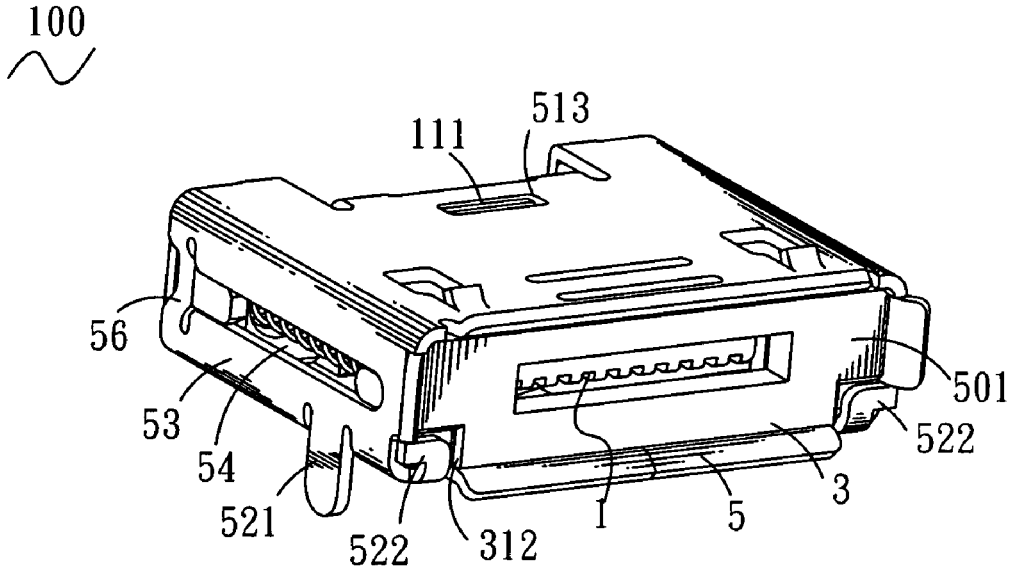
FIG. 1 is a perspective view of an electrical connector according to the present invention.
Figure 2:
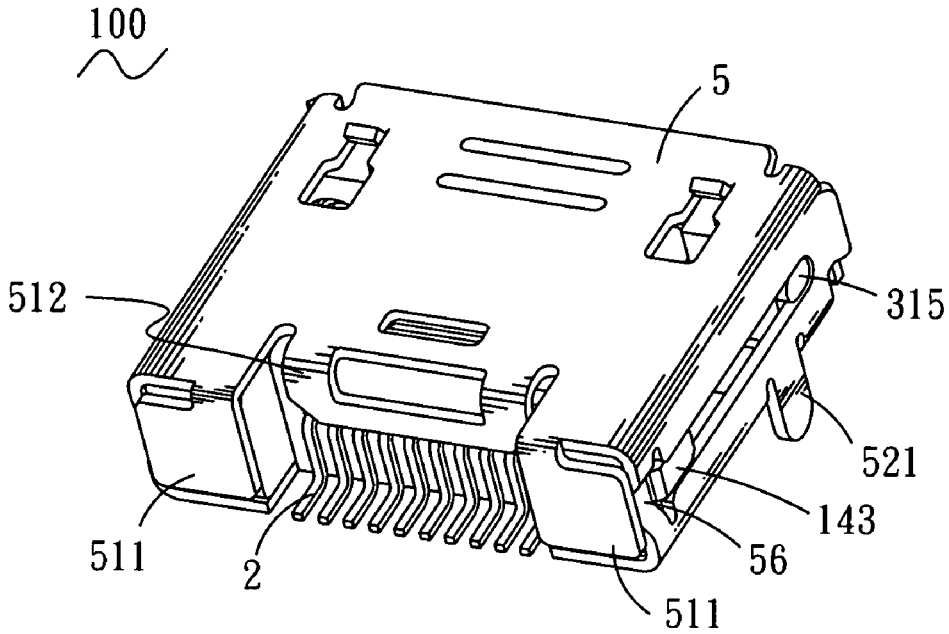
FIG. 2 is another perspective view of the electrical connector shown in FIG. 1.
Figure 3:
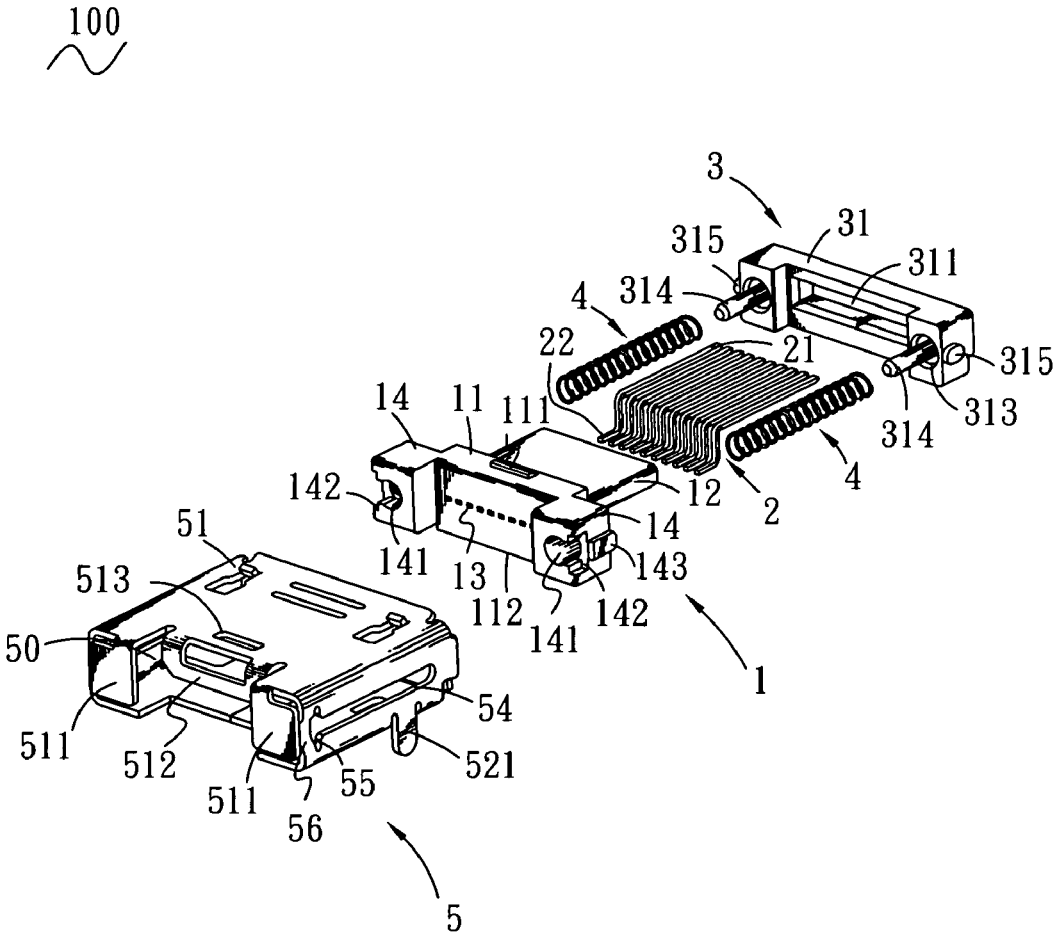
FIG. 3 is an exploded view of the electrical connector shown in FIG. 1.

With reference to FIGS. 1-3, an electrical connector 100 according to the present invention includes a dielectric housing 1, a plurality of terminals 2 received in the dielectric housing 1, a dustproof cover 3, two coils of springs 4, and a shield 5.

Figure 4:
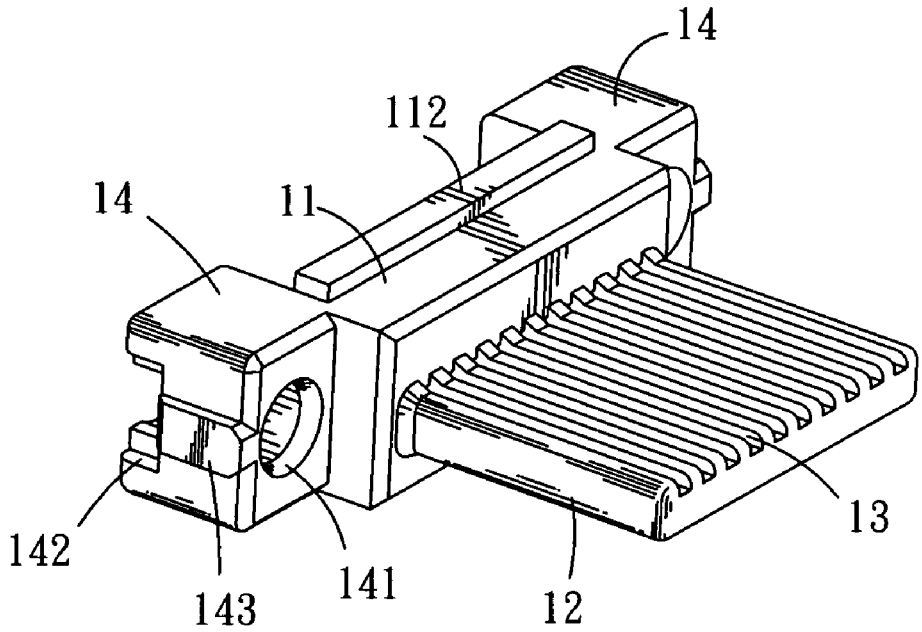
FIG. 4 is a perspective view of a dielectric housing of the electrical connector shown in FIG. 1.

Please refer to FIGS. 1, 3 and 4, the dielectric housing 1 has a substantially rectangular basic portion 11. The middle of a rear surface of the basic portion 11 extends rearward to form an extending board 12. A plurality of terminal grooves 13 is abreast formed in the basic portion 11 and a bottom surface of the extending board 12 and extends from a front surface of the basic portion 11 to a rear end of the extending board 12. A first bump 111 is protruded upward from a top surface of the basic portion 11. An elongated second bump 112 is protruded downward from a bottom surface of the basic portion 11. Two rectangular lumps 14 respectively extend outward from two ends of the basic portion 11. Each of the lumps 14 defines a hole 141 extending from a front surface of the lump 14 to a rear surface thereof. A rectangular recess 142 is formed in the junction of the front surface and an outer surface of each of the lumps 14. The two recesses 142 respectively communicate with the corresponding holes 141. A pair of projections 143 respectively protrude outward from the outer surface of the two lumps 14.

With reference to FIG. 3, each of the terminals 2 includes a contact portion 21 and a soldering portion 22 bending and extending from a front end of the contact portion 21. The contact portion 21 is received in the terminal groove 13 and the soldering portion 22 extends out of the dielectric housing 1.

Please refer to FIGS. 1 and 3, the dustproof cover 3 of a substantially rectangular shape has a main body 31. An elongated rectangular slot 311 is formed in the middle of the main body 31 and extends from a front surface to a rear surface. Two cuts 312 are respectively formed in two ends of the bottom of the rear surface of the main body 31. Two cylindrical openings 313 are respectively formed in two ends of the front surface of the main body 31. A bottom of each opening 313 extends forward to form a rod 314 which extends out of the main body 31. A pair of oval-shaped guiding portions 315 is respectively protruded outward from two outsides of the main body 31.

Figure 5:
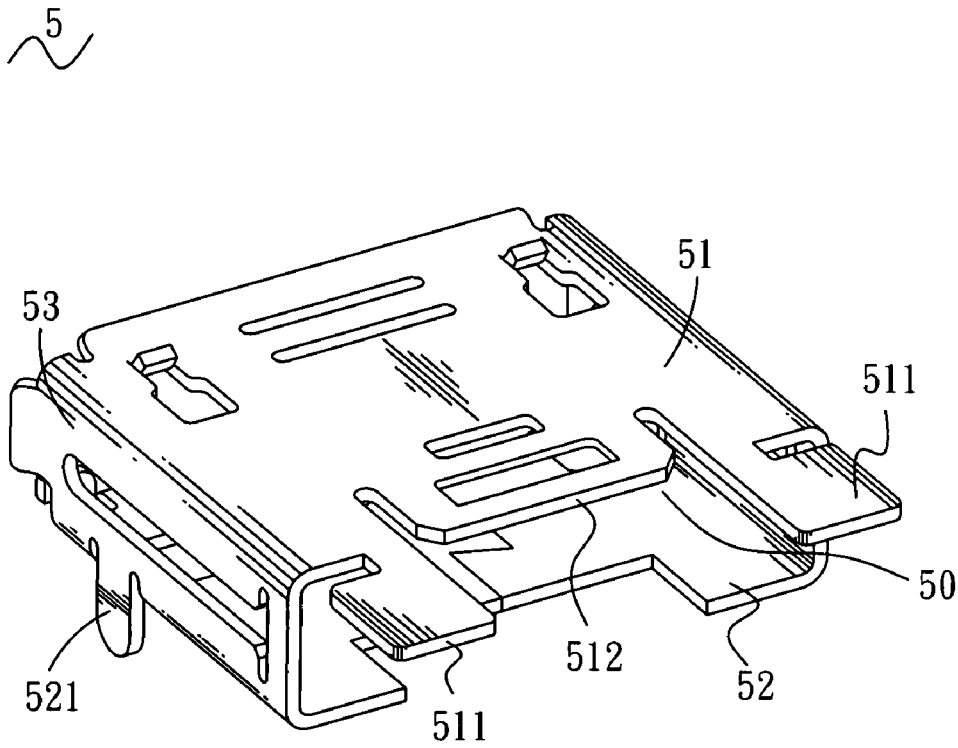
FIG. 5 is a perspective view of a shield of the electrical connector shown in FIG. 1 before being assembled.
Figure 6:
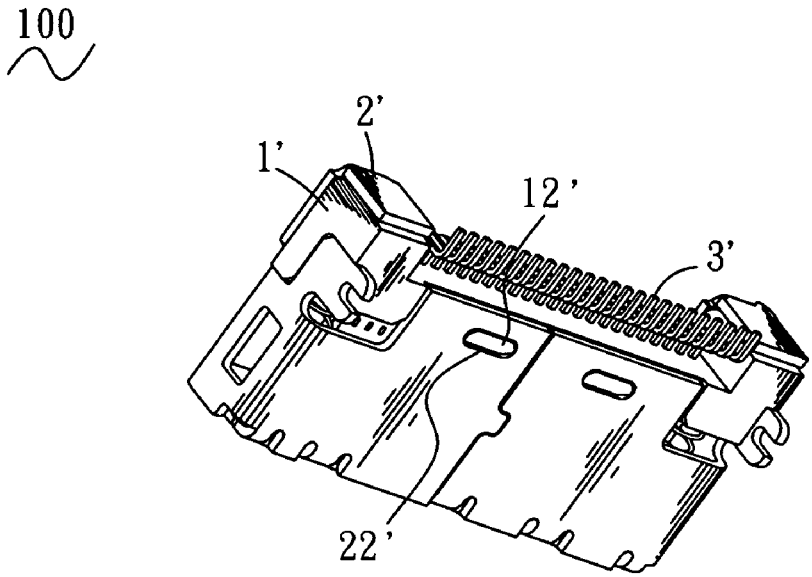
FIG. 6 is a perspective view of a conventional electrical connector.
Figure 7:
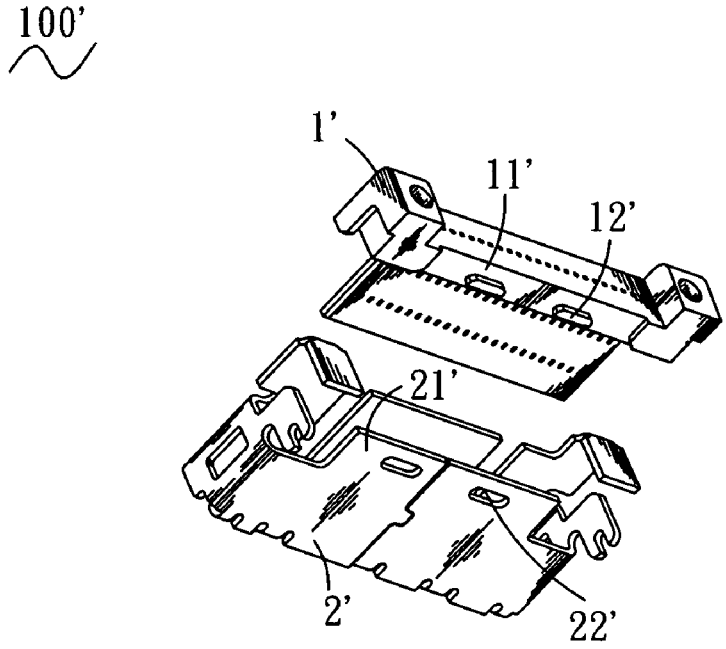
FIG. 7 is a perspective view of a dielectric housing apart from a shield of the conventional electrical connector.

Please refer to FIGS. 1, 3 and 5, the shield 5 includes a top board 51, a bottom board 52 opposite to the top board 51, and two sideboards 53 connected to the two sides of the top board 51 and the bottom board 52. A receiving space 50 is surrounded by the top board 51, the bottom board 52 and the sideboards 53. A rear end of the shield 5 defines an inserting mouth 501 for allowing a complement connector (not shown) inserting into the receiving space 50 therefrom. Two ends of a front end of the top board 51 extend forward abreast to form two retaining pieces 511. The middle of the front end of the top board 51 is cut to form a tab 512 between the two retaining pieces 511. An aperture 513 is formed in the top board 51 behind the tab 512. Two elongated sliding grooves 54 are symmetrical respectively formed in the two sideboards 53. A slit 55 is formed in a front end of each of the sliding groove 54. The slit 55 communicates with the sliding groove 54 and is perpendicular to the sliding groove 54. The middle of the junctions of the bottom board 52 and the two sideboards 53 extend downward to form a pair of fixing pieces 521. The fixing pieces 521 extend out of the shield 5 and are inserted into a printed circuit board (not shown) to fix the electrical connector 100 on the printed circuit board. Two hooks 522 extend and bend upward from a rear end of the bottom board 52 adjacent to the two sideboards 53.

Please refer to FIGS. 1 and 2, in assembly, firstly, the dustproof cover 3 is inserted into the shield 5 through the front end of the shield 5 until the dustproof cover 3 is restricted by the hooks 522 of the shield 5. More specially, the two guiding portions 315 are respectively inserted into the two sliding grooves 54 and then slide rearward along the sliding grooves 54. Secondly, the dielectric housing 1 assembled with the terminals 2 is inserted into the shield 5 through the front end of the shield 5. The rear end of the extending board 12 of the dielectric housing 1 is inserted into the slot 311 of the dustproof cover 3. The two projections 143 are respectively received in the sliding grooves 54. The first bump 111 is inserted into the aperture 513 of the shield 5. The second bump 112 is restricted by the front end of the bottom board 52 of the shield 5. Thirdly, one end of each of the springs 4 passes through the hole 141 of the dielectric housing 1, and then the end of the spring 4 is received in the opening 313 and surrounds the rod 314 of the dustproof cover 3. The opposite end of each of the springs 4 is received in the hole 141 of the dielectric housing 1. At last, the two retaining pieces 511 of the shield 5 are respectively bent downward to cover the two holes 141 and restrict the springs 4 in the holes 141. The tab 512 is bent downward to be attached to the front end of the dielectric housing 1. The part of each of the sideboards 53 between a front side of the sideboard 53 and the slit 55 is respectively punched inward to form a retaining portion 56 which is restricted in the corresponding recesses 142 of the dielectric housing 1.

As described above, after the dielectric housing 1 is mounted in the shield 5, the retaining portions 56 of the shield 5 are punched to be restricted in the recesses 142 formed in the dielectric housing 1, the depth of the recesses 142 and the retaining portions 56 restricted in the recesses 142 is not limited by the depth of the material of the shield 5. The dielectric housing 1 is fixed in the shield 5 firmly. When the electrical connector 100 engages with the complementary connector, the dielectric housing 1 avoids removing from the shield 5 even the dielectric housing 1 is suffered by a push force.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An electrical connector, comprising:

a dielectric housing defining a plurality of terminal grooves therein, at least one recess being formed in an outer surface of the dielectric housing;

a plurality of terminals received in the terminal grooves of the dielectric housing; and a shield having a plurality of sidewalls defining a receiving space therebetween for receiving the dielectric housing therein, at least one of the sidewalls being punched inward at a portion corresponding to the recess of the dielectric housing to form a retaining portion received in the recess after the dielectric housing is mounted in the receiving space, the at least one sidewall defining a slit spaced from and adjacent to one end of the sidewall to make the retaining portion being punchingly formed therebetween facilely.

2. The electrical connector as claimed in claim 1, wherein the retaining portion is respectively formed at substantially symmetrical portions of the two opposite sidewalls for being restricted in the recess respectively defined in two opposite surfaces of the dielectric housing.

3. The electrical connector as claimed in claim 1, wherein the dielectric housing is inserted into the receiving space of the shield from an end of the shield adjacent to the slit, an opposite end of the shield defines an insertion mouth for allowing insertion of a complementary connector.

4. The electrical connector as claimed in claim 1, wherein the retaining portion is respectively formed at the two opposite sidewalls for being received in the recess respectively defined in two opposite surfaces of the dielectric housing.

5. The electrical connector as claimed in claim 4, wherein the sidewalls respectively define a sliding groove extending along an insertion direction of the dielectric housing and communicating with and being substantially perpendicular to the corresponding slit.

6. The electrical connector as claimed in claim 5, further comprising a dustproof cover received in the receiving space of the shield, two sides of the dustproof cover protruded outward to form two guiding portions respectively arranged in the two sliding grooves of the shield.

7. The electrical connector as claimed in claim 1, wherein the shield has a top board, a middle of one end of the top board is cut to form a tab, after the dielectric housing is mounted in the shield, the tab is bent downward to be attached to the dielectric housing.

8. An electrical connector, comprising:

a dielectric housing defining a plurality of terminal grooves therein, at least one recess being formed in an outer surface of the dielectric housing;

a plurality of terminals received in the terminal grooves of the dielectric housing; and a shield having a plurality of sidewalls defining a receiving space therebetween for receiving the dielectric housing therein, at least one of the sidewalls being punched inward at a portion corresponding to the recess of the dielectric housing to form a retaining portion received in the recess after the dielectric housing is mounted in the receiving space, the shield having a top board, a middle of one end of the top board being cut to form a tab, wherein after the dielectric housing is mounted in the shield, the tab is bent downward to be attached to the dielectric housing.

9. The electrical connector as claimed in claim 8, wherein the retaining portions is respectively formed at substantially symmetrical portions of the two opposite sidewalls for being received in the recess respectively defined in two opposite surfaces of the dielectric housing.

* * * * *